US012391340B2

(12) United States Patent
Chellakat et al.

(10) Patent No.: US 12,391,340 B2
(45) Date of Patent: Aug. 19, 2025

(54) SYSTEM AND METHOD FOR MOORING AND ANCHORING OF FLOATING SOLAR ARRAYS ON WATER SURFACE

(71) Applicants: Joe Joe Satyaraj Chellakat, Kochi (IN); Rahul Kanotra, Jaipur (IN)

(72) Inventors: Joe Joe Satyaraj Chellakat, Kochi (IN); Rahul Kanotra, Jaipur (IN)

( * ) Notice: Subject to any disclaimer, the term of this patent is extended or adjusted under 35 U.S.C. 154(b) by 400 days.

(21) Appl. No.: 17/778,219

(22) PCT Filed: Nov. 24, 2021

(86) PCT No.: PCT/IN2021/051093
§ 371 (c)(1),
(2) Date: May 19, 2022

(87) PCT Pub. No.: WO2022/113103
PCT Pub. Date: Jun. 2, 2022

(65) Prior Publication Data

US 2022/0411026 A1 Dec. 29, 2022

(30) Foreign Application Priority Data

Nov. 25, 2020 (IN) ..... 202041051425

(51) Int. Cl.

| | |
|---|---|
| ***B63B 21/50*** | (2006.01) |
| ***B63B 21/20*** | (2006.01) |
| ***B63B 22/02*** | (2006.01) |
| ***B63B 35/44*** | (2006.01) |

(52) U.S. Cl.
CPC ..... *B63B 21/50* (2013.01); *B63B 21/20* (2013.01); *B63B 22/02* (2013.01); *B63B 35/44* (2013.01); *B63B 2021/203* (2013.01); *B63B 2035/4453* (2013.01)

(58) Field of Classification Search
CPC ... H02S 20/00; B63B 21/50; B63B 2021/203; B63B 2035/4453
See application file for complete search history.

(56) References Cited

U.S. PATENT DOCUMENTS

2018/0034408 A1* 2/2018 Julian ..... H02S 40/32
2020/0153379 A1* 5/2020 Motohashi ..... H02S 20/30

FOREIGN PATENT DOCUMENTS

KR 1662477 B1 * 10/2016 ..... B63B 22/166

* cited by examiner

*Primary Examiner* — Andrew Polay
(74) *Attorney, Agent, or Firm* — Jose Cherson Weissbrot

(57) ABSTRACT

A system (100) and method for mooring and anchoring of floating solar panels (150) on water surface is disclosed. The system (100) has a floater unit (154) for securing the solar panels (150). The floater unit (154) has securing means (152) along its circumference. Buoys (122, 124, 126, 128) are floated on the surface of the water body such that each buoy is anchored to at least one anchor (142, 144, 146, 148) at a floor of the water body. Main mooring lines (112, 114, 116, 118) are connected to the buoys (122, 124, 126, 128). A parabolic curve is formed by connecting one end of the adjacent main mooring lines to the same buoy. A plurality of connecting lines (162, 164, 166, 168) are used for connecting each main mooring line (112, 114, 116, 118) with the securing means (152) at corresponding side of the floater unit (154).

12 Claims, 6 Drawing Sheets

SYSTEM AND METHOD FOR MOORING AND ANCHORING OF FLOATING SOLAR ARRAYS ON WATER SURFACE

TECHNICAL FIELD

The present disclosure relates generally to a system and method for mooring and anchoring of floating solar arrays on water surface. Embodiments of the disclosure are related to a mooring and anchoring of floating solar arrays on water surface that ensures even distribution of load acting on the solar arrays.

BACKGROUND

Floating solar or Floating Photovoltaic (FPV), is a solar array that floats on a body of water. The solar panels are generally placed on a buoyant structure to keep them above the surface of water and are usually located on bodies of water such as ponds, lakes and other man-made reservoirs.

Floating solar arrays consists of multiple floating buoys or rectangular floating bodies joined together to form a large floating array. Solar panels are installed on top of these floating bodies. These floating bodies are subjected to external loads from the environment. Environmental loads are mainly from wind and also from current and waves depending on the location of mooring. It is essential to hold the floating array at the desired designated location in order to facilitate the connection of electrical cables to the inverter and subsequently to power transmission lines.

Floating arrays are generally moored by deadweight anchors or pile anchors installed on to the floor of the water body like reservoir, lake or sea. Mooring lines connect the floating array from the lug or securing means on the floater to the anchor at the bottom of the water body.

Individual floaters are usually made from high density plastic or similar material. Lugs or Ears are provided on corners of each floaters. These lugs or ears are used for connecting the mooring lines for mooring the array as well as for connecting one floater with other floaters.

Various mooring methods are presently used for the mooring of the solar arrays. Almost all of them involves the use of multiple anchors which are placed on the seabed or bottom of the water body. The capacity of the lugs or ears on these floaters are not strong enough to resist the large environmental load arising from the multiple floating bodies. Hence to distribute the relatively huge environmental loads on the large array, multiple mooring lines and multiple anchors are provided.

The requirement of multiple anchors and the precision required to install these anchors on the bottom of the water body makes the installation of the floating solar arrays a challenging task. These multiple anchors increase the cost of the mooring system as well as the cost required for installing many anchors.

A need, therefore, exists for an improved system and method for mooring and anchoring of floating solar arrays on water surface that uses fewer mooring lines and anchors which also ensures equal distribution of load acting on the solar arrays.

SUMMARY

The following summary is provided to facilitate an understanding of some of the innovative features unique to the disclosed embodiment and is not intended to be a full description. A full appreciation of the various aspects of the embodiments disclosed herein can be gained by taking into consideration the entire specification, claims, drawings, and abstract as a whole.

The present disclosure relates generally to a system and method for mooring and anchoring of floating solar arrays on water surface. Embodiments of the disclosure are related to a mooring and anchoring of floating solar arrays on water surface that ensures even distribution of load acting on the solar arrays.

In a first aspect of the present disclosure, a system for mooring and anchoring at least one set of solar panels on a surface of a water body, the system characterized in that comprising: at least one floater unit for securing the solar panel, wherein the floater unit comprises a plurality of securing means along the circumference; at least one or more parabolic curved main mooring line for forming a main securing means of the floater unit along the circumference; a plurality of buoys floating on the surface of the water body, wherein each buoy is anchored to at least one anchor at a floor of the water body; wherein the parabolic curved main mooring line is attached to the buoys or to the anchor point on a shore of the water body; and a plurality of connecting lines, each for connecting a side of the floater unit to one of the main parabolic mooring line, wherein a length of each connecting line is equal to a geometric distance between the securing means in one side of the floater unit and the respective parabolic curved main mooring line.

According to an embodiment in conjunction to the first aspect of the present disclosure, wherein the parabolic curved main mooring line and the connecting lines form a web structure.

According to an embodiment in conjunction to the first aspect of the present disclosure, wherein the connecting line connecting a center of the parabolic curved main mooring line is shorter than the connecting line connecting a sides of the parabolic curved main mooring line.

According to an embodiment in conjunction to the first aspect of the present disclosure, wherein the length of the connecting line near the buoys are greater than the length of the connecting line away from the buoys.

According to an embodiment in conjunction to the first aspect of the present disclosure, wherein the parabolic curved main mooring line and the connecting lines equally distribute the load acting on the solar panel.

According to an embodiment in conjunction to the first aspect of the present disclosure, wherein the parabolic curved main mooring line and the connecting lines are connected such that to avoid localized stress on each securing means of the floater unit.

According to an embodiment in conjunction to the first aspect of the present disclosure, wherein the buoys and the anchor are connected using one or more anchor mooring lines.

According to an embodiment in conjunction to the first aspect of the present disclosure, wherein the connecting lines connecting the parabolic curved main mooring line has one or more additional buoys.

According to an embodiment in conjunction to the first aspect of the present disclosure, wherein ends of the parabolic curved main mooring line connected to the buoys has one or more tightening chain.

According to an embodiment in conjunction to the first aspect of the present disclosure, wherein the buoys has one or more marker lights.

According to an embodiment in conjunction to the first aspect of the present disclosure, wherein the number and size of the buoyancy buoys depends on the floating requirements of the parabolic curved main mooring line.

In a second aspect of the present disclosure, a method for mooring and anchoring at least one solar array on a surface of a water body, the method characterized in that comprising: installing at least one floater unit for securing the solar panel, wherein the floater unit comprises a plurality of securing means along the circumference; installing a plurality of buoys on the surface of the water body, wherein each buoy is anchored to at least one anchor at a floor of the water body; connecting at least four parabolic curved main mooring line to the buoys, forming a parabolic curve of main mooring line by connecting one end of the adjacent main mooring lines to the same buoy; and connecting a plurality of connecting lines between each main mooring line with the securing means at corresponding side of the floater unit.

According to an embodiment in conjunction to the second aspect of the present disclosure, wherein the method of further comprises: connecting the connecting line between the parabolic curved main mooring line and the floater unit such that the length of the connecting line at the centre of the parabolic curved main mooring line is shorter than the length of the connecting line connecting the sides of the parabolic curved main mooring line; forming a web structure by connecting the connecting lines between the parabolic curved main mooring line and the floater unit; equally distributing, by the web structure, load acting on the solar panel; and avoiding, by the web structure, localized stress on each securing means of the floater unit.

According to an embodiment in conjunction to the second aspect of the present disclosure, wherein the method further comprises: connecting the connecting line between the parabolic curved main mooring line and the floater unit such that the length of the connecting line near the buoys are greater than the length of the connecting line away from the buoys; forming a web structure by connecting the connecting lines between the parabolic curved main mooring line and the floater unit; equally distributing, by the web structure, load acting on the solar array; and avoiding, by the web structure, localized stress on each securing means of the floater unit.

According to an embodiment in conjunction to the second aspect of the present disclosure, wherein the method further comprises: connecting the buoys and the anchor using one or more anchor mooring lines; connecting the connecting lines and the parabolic curved main mooring line using one or more additional buoys; connecting the ends of the parabolic curved main mooring line to the buoys using one or more tightening chain; and installing one or more marker lights on the buoys.

A system and method for mooring and anchoring of floating solar panels on water surface is disclosed. The system has a floater unit for securing the solar panels. The floater unit has securing means along its circumference. Buoys are floated on the surface of the water body such that each buoy is anchored to at least one anchor at a floor of the water body. Main mooring lines are connected to the buoys. A parabolic curve is formed by connecting one end of the adjacent main mooring lines to the same buoy. A plurality of connecting lines are used for connecting each main mooring line with the securing means at corresponding side of the floater unit.

Figure 1:
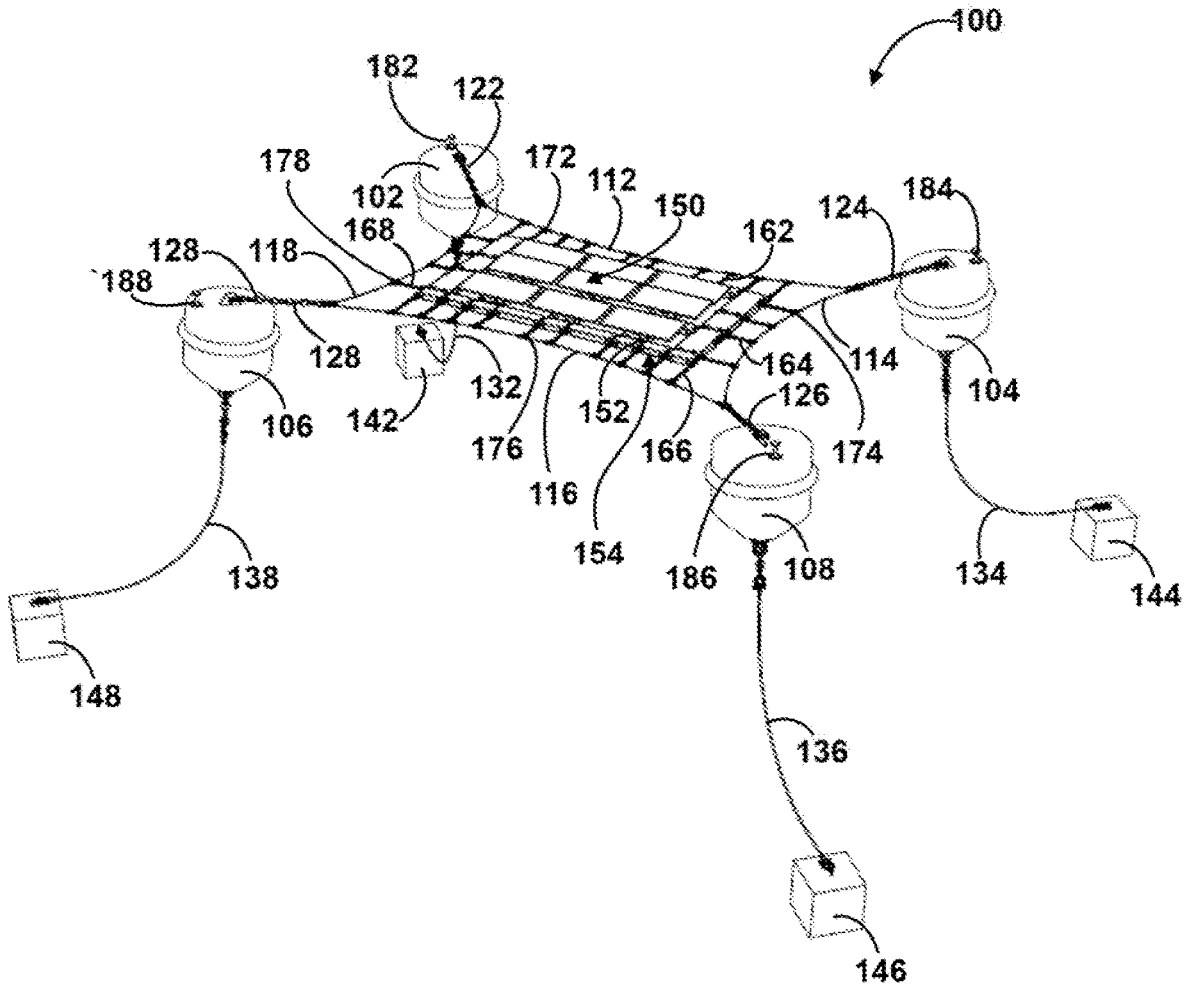
FIG. 1 is a perspective view of an example system for mooring and anchoring at least one solar array on a surface of a water body, in accordance with the disclosed embodiment of the invention.

The summary above, as well as the following detailed description of illustrative embodiments, is better understood when read in conjunction with the appended drawings. For the purpose of illustrating the present disclosure, exemplary constructions of the disclosure are shown in the drawings. However, the disclosure is not limited to specific methods and instrumentalities disclosed herein. Moreover, those in the art will understand that the drawings are not to scale. Wherever possible, like elements have been indicated by identical numbers.

DETAILED DESCRIPTION OF ILLUSTRATIVE EMBODIMENTS

The particular configurations discussed in the following description are non-limiting examples that can be varied and are cited merely to illustrate at least one embodiment and are not intended to limit the scope thereof.

The present invention is a unique concept of mooring floating solar arrays termed as 'web mooring', which consists of a parabolic or curved mooring line. The ends of the 'web mooring' are connected to the anchors through floating buoys connected at its ends. The requirement of multiple anchors necessary for mooring the typical solar arrays are not required for the present invention. The anchors are placed only at the ends of the web mooring line. The mooring lines from the individual floaters can be connected to the 'web mooring' line. Any number of lines can be added from the floating array to the web mooring line. The increased number of lines will reduce the mooring load on the individual lugs of the floaters of the floating arrays.

It is mathematically derived that a flexible cable or line under its self-weight takes the shape of a parabolic curve also known as a catenary. For example, the shape of power cables hanging between two poles is a catenary. Another example of a catenary curve is a suspension bridge where the profile of the main cable (on which the bridge hangs through connecting cables) is a parabolic curve. In both these examples, the load on the cable (self-weight in case of power cable and weight of bridge acting on the main cable of a suspension bridge) is acting in the vertical direction and therefore the catenary curve is naturally formed in the vertical direction.

The present invention uses this principle of the natural shape (under uniform loading) of the cable to moor a floating solar array. However, instead of the load acting in the vertical direction, in present invention, the load due to the environment acts in the horizontal direction. In the mooring design of present invention, a rectangular solar array is moored using four main lines which are connected to four or more buoys through the mooring chain. The main lines can be made of any material not limited to, polyester, polyamide, nylon, steel wire rope, chain, and so on. The floating buoys in turn are connected to the ground anchors through anchor mooring lines. The anchor mooring lines can be made of any material such as, not limited to polyester, polyamide, nylon, steel wire rope, chain, and so on. The ground anchors can be concrete blocks or piles driven in the seabed. The rectangular floating solar array is connected to the four main lines by several connecting cables along the length of each side. The outer end of connecting cables is attached to the main lines and the inner end is attached to the lugs on the pontoons. The floating solar array is assembled by interconnecting thousands of pontoons. The length of connecting cables at any given location is equal to the geometric distance between the edge of the solar array and the main line (web mooring line) that forms a parabola. Therefore, the connecting cables at the center are shorter than the connecting cables at the extremes. This scheme ensures that when the environmental loads (due to wind, currents) are acting on any side of the solar array, they are equally distributed among all the lugs along the length of the solar array thereby not increasing localized stresses on individual lugs.

FIG. 1 is a perspective view of an example system 100 for mooring and anchoring at least one set of solar panels 150 on the surface of a water body, in accordance with the disclosed embodiment of the invention. The system 100 has at least one set of floater unit 154 for securing the solar array. The floater unit 154 comprises a plurality of securing means 152 along the circumference. The solar panels 150, for example, Floating Photovoltaic (FPV) are placed over the floaters using multiple securing means. It should be noted that the securing means used for securing solar panels to the floater depends on the type of the floater.

One or more parabolic curved main mooring lines 112, 114, 116 and 118 forms a main securing means of the floater unit 154 along the circumference. A plurality of buoys 102, 104, 106 and 108 floating on the surface of the water body are anchored to at least one anchor 142, 144, 146 and 148 at a floor of the water body via one or more anchor mooring lines 132, 134, 136 and 138. The anchors 142, 144, 146 and 148 will hold the mooring lines 112, 114, 116 and 118 from array to the floor of the water body. The anchors 142, 144, 146 and 148 can be either deadweight gravity anchor or a pile anchor. The deadweight anchors are made from a marine grade concrete reinforced with steel bars. The buoys 102, 104, 106 and 108 and the anchors 142, 144, 146, 148 are connected using one or more anchor mooring lines 132, 134, 136 and 138 respectively.

The anchor mooring lines 132, 134, 136 and 138 are connecting the floating buoy 102, 104, 106 and 108 on the surface of water to the anchor on the bottom. Material of the anchor mooring lines 132, 134, 136 and 138 can be, not limited to steel wire, polyester or composite ropes.

The parabolic curved main mooring line also referred as main mooring lines 112, 114, 116 and 118, are attached to the buoys 102, 104, 106 and 108. In one embodiment of the invention, the main mooring line 112, 114, 116 and 118 can be attached to the anchor point on a shore of the water body.

A plurality of connecting lines 162, 164, 166 and 168 are connected to each side of floaters to the main parabolic mooring lines 112, 114, 116 and 118, as shown in FIG. 1. The length of each connecting line 162, 164, 166 or 168 is equal to a geometric distance between the securing means 154 and the main mooring line 112, 114, 116 and 118.

The parabolic curved main mooring line 112, 114, 116, 118 and the connecting lines 162, 164, 166, 168 forms a web like structure, it should be noted that the buoys 102, 104, 106 and 108 connects the anchor mooring line 132, 134, 136 and 138 with the parabolic curved main mooring line 112, 114, 116, 118. The buoys 102, 104, 106 and 108 takes the weight of the anchor mooring line 132, 134, 136 and 138 and partial weight of the parabolic curved main mooring line 112, 114, 116, 118. The buoys 102, 104, 106 and 108 can be made from, not limited to steel, polyester or other floating materials.

The parabolic curved main mooring lines 112, 114, 116 and 118 can transfers the load from one or more floaters 154 to the anchor 142, 144, 146, 148 through the buoys 102, 104, 106 and 108 and the anchor mooring line 132, 134, 136 and 138. The parabolic or the curved nature of the main mooring line 112, 114, 116, 118 configuration helps it to evenly distribute the load from the floater unit 154 of the solar panel 150 without overloading the securing means 154.

The connecting lines 162, 164, 166, 168 can transfer the load from the floater unit 154 of the solar panel 150 to the main mooring lines 112, 114, 116 and 118. There can be as many number of connecting lines 162, 164, 166, 168 connecting the floater unit 154 to the main mooring line 112, 114, 116, 118 so as to reduce the mooring loads to the acceptable limits of the securing means 152 of the floater unit 154. It should be noted that the floater unit 154 can have one or more floaters joined together by connecting the securing means 152 of adjacent floaters. The connecting lines 162, 164, 166, 168 connects the main mooring lines 112, 114, 116 and 118 and one or more securing means 152 of the floater unit 154, such that the length of each connecting line 162, 164, 166, 168 is equal to a geometric distance between the securing mean 162 to which at least one of connecting line 162, 164, 166 or 168 is connected.

In one embodiment of the invention, the connecting line 162, 164, 166, 168 connecting a center of the parabolic curved main mooring line 112, 114, 116, 118 is shorter than the connecting line 162, 164, 166, 168 connecting a side of the parabolic curved main mooring line 112, 114, 116, 118. In another embodiment of the invention, the length of the connecting line 162, 164, 166, 168 near the buoys 102, 104, 106 and 108 are greater than the length of the connecting line 162, 164, 166, 168 away from the buoys 102, 104, 106 and 108.

The main advantage of the present invention is that in the web structure, the parabolic curved main mooring line 112, 114, 116, 118 and the connecting lines 162, 164, 166, 168 can equally distribute the load acting on the solar panel 160. Further, another advantage of the present invention is that, the parabolic curved main mooring lines 112, 114, 116, 118 and the connecting lines 162, 164, 166, 168 are connected such that to avoid localized stress on each securing means 162 of the floater unit 154.

Figure 2:
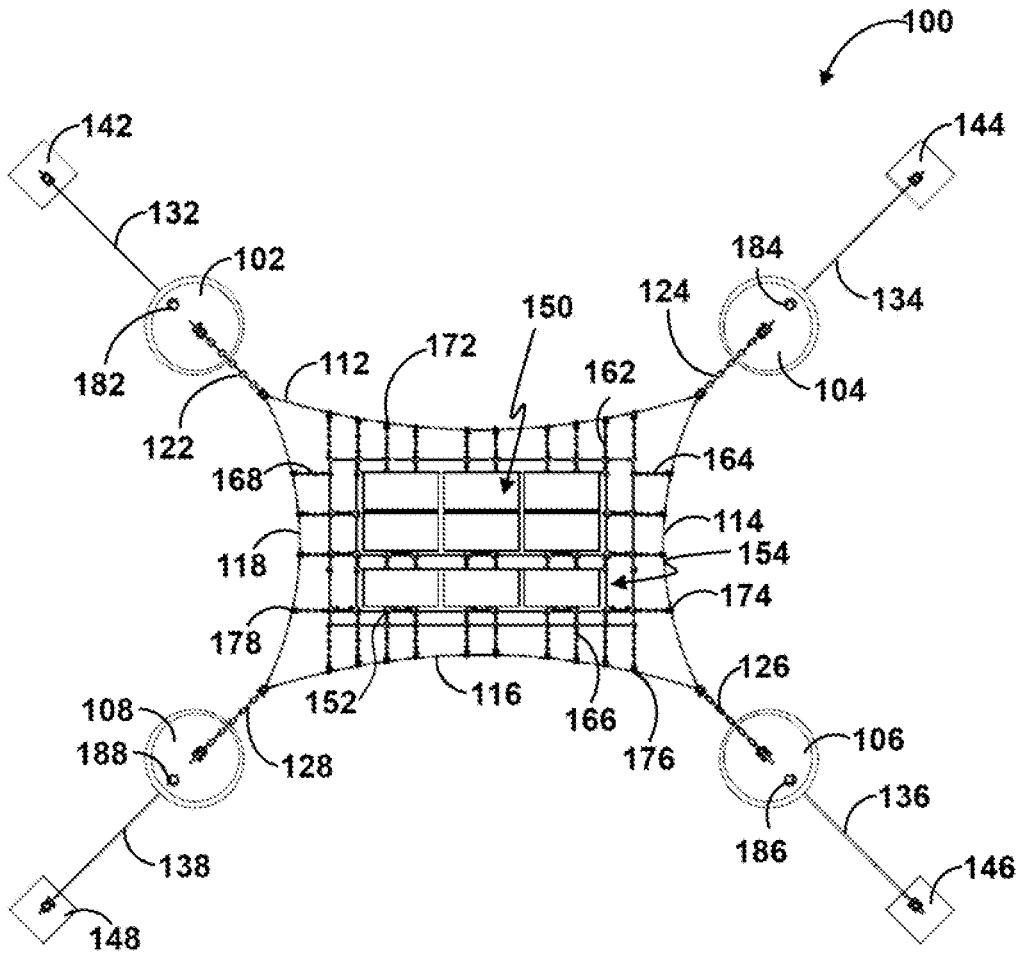
FIG. 2 is a top view of an example system for mooring and anchoring at least one solar array on a surface of a water body, in accordance with the disclosed embodiment of the invention.

FIG. 2 is a top view of an example system for mooring and anchoring at least one solar array on a surface of a water body, in accordance with the disclosed embodiment of the invention. The parabolic curved main mooring line 112, 114, 116, 118 transfers the load from the solar panel 150 to the anchor 142, 144, 146, 148 through the buoys 102, 104, 106 and 108 and the anchor mooring lines 132, 134, 136 and 138. The parabolic or the curved nature of the main mooring line 112, 114, 116, 118 configuration helps it to evenly distribute the load from the floater unit 164 of the solar panel 150 without overloading the securing means 152 of the array of floaters. Material of the anchor mooring lines 132, 134, 136 and 138 can be of steel wire, polyester or composite ropes. The connecting lines 162, 164, 166, 168 can transfer the load from the floater unit 154 of the solar panel 150 to the main mooring lines 112, 114, 116, 118. There can be as many connecting lines 162, 164, 166, 168 connecting the floater unit 154 to the main mooring lines 112, 114, 116, 118, so as to reduce the mooring loads to the acceptable limits of the securing means 152 on the floaters.

It should be noted that the floater unit 162 with solar panel 150 comprises of the individual floaters combined together at the securing means 152 on each floaters. Then the solar panels can be installed on the floater unit 154.

The system 100 has one or more additional buoyancy buoys 172, 174, 176, 178 attached to the parabolic curved main mooring line 112, 114, 116, 118 in order to make it float at the desired level. The number and size of the buoyancy buoys 172, 174, 176, 178 depends on the floating requirements of the parabolic curved main mooring line 112, 114, 116, 118. One or more tightening chains 122, 124, 126, 128 are provided at the ends of the parabolic curved main mooring lines 112, 114, 116, 118 in order to provide the required pretension on to the parabolic curved main mooring line 112, 114, 116, 118, after installing the system 100 at site. The system 100 also has one or more marker lights 182, 184, 186, 188 to indicate the location of the buoys 102, 104, 106 and 108 during night or in foggy conditions.

Figure 3:
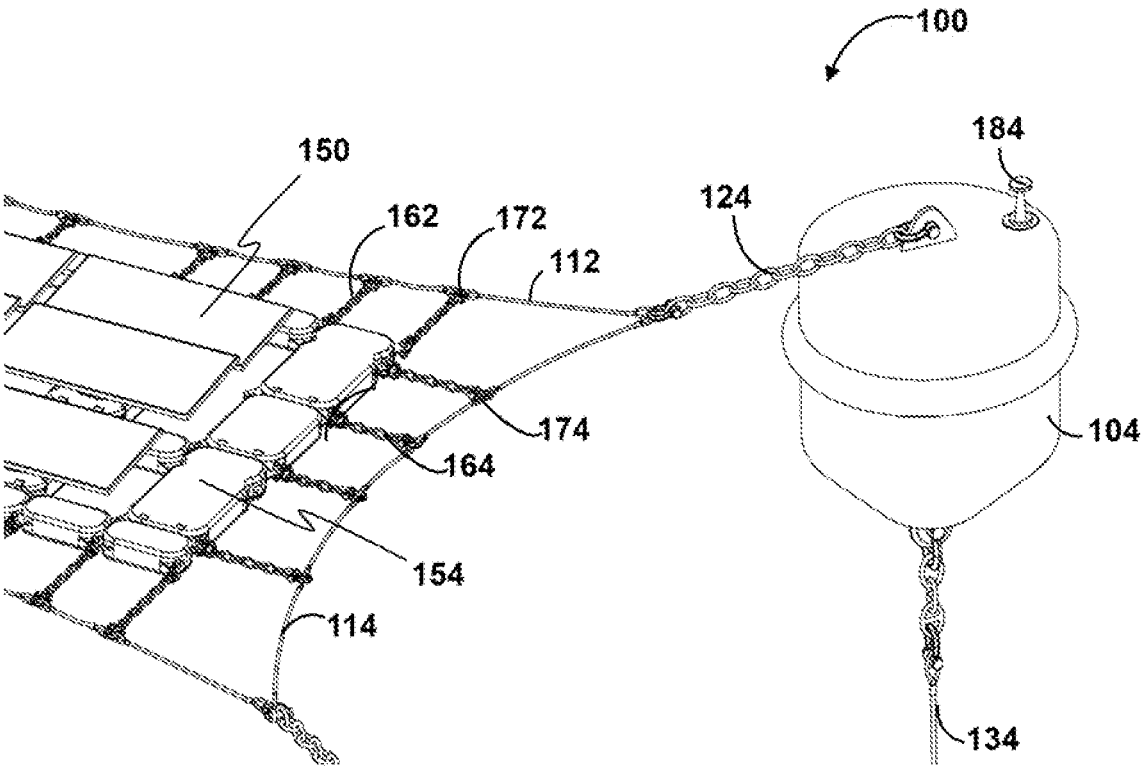
FIG. 3 is a perspective view of an example system of FIG. 1 showing a buoy connected to the main mooring lines and also showing the main mooring lines connected to the floating unit using the connecting lines, in accordance with the disclosed embodiment of the invention.

FIG. 3 is a perspective view of an example system of FIG. 1 showing the buoy 104 connected to the main mooring lines 112 and 114 and also showing the main mooring lines 112 and 114 connected to the floating unit 164 using the connecting lines for example, the connecting lines 162 and 164 respectively. The length of connecting, lines 162 and 164 at any given location is equal to the geometric distance between the edge of the solar array and the main line (web mooring line) 112 and 114 that forms a parabola. Therefore, the connecting lines at the center are shorter than the connecting lines at the extremes as shown in FIG. 3. This scheme ensures that when the environmental loads (due to wind, currents) are acting on any side of the solar array, they are equally distributed among all the lugs along the length of the solar array thereby not increasing localized stresses on individual lugs.

Figure 4:
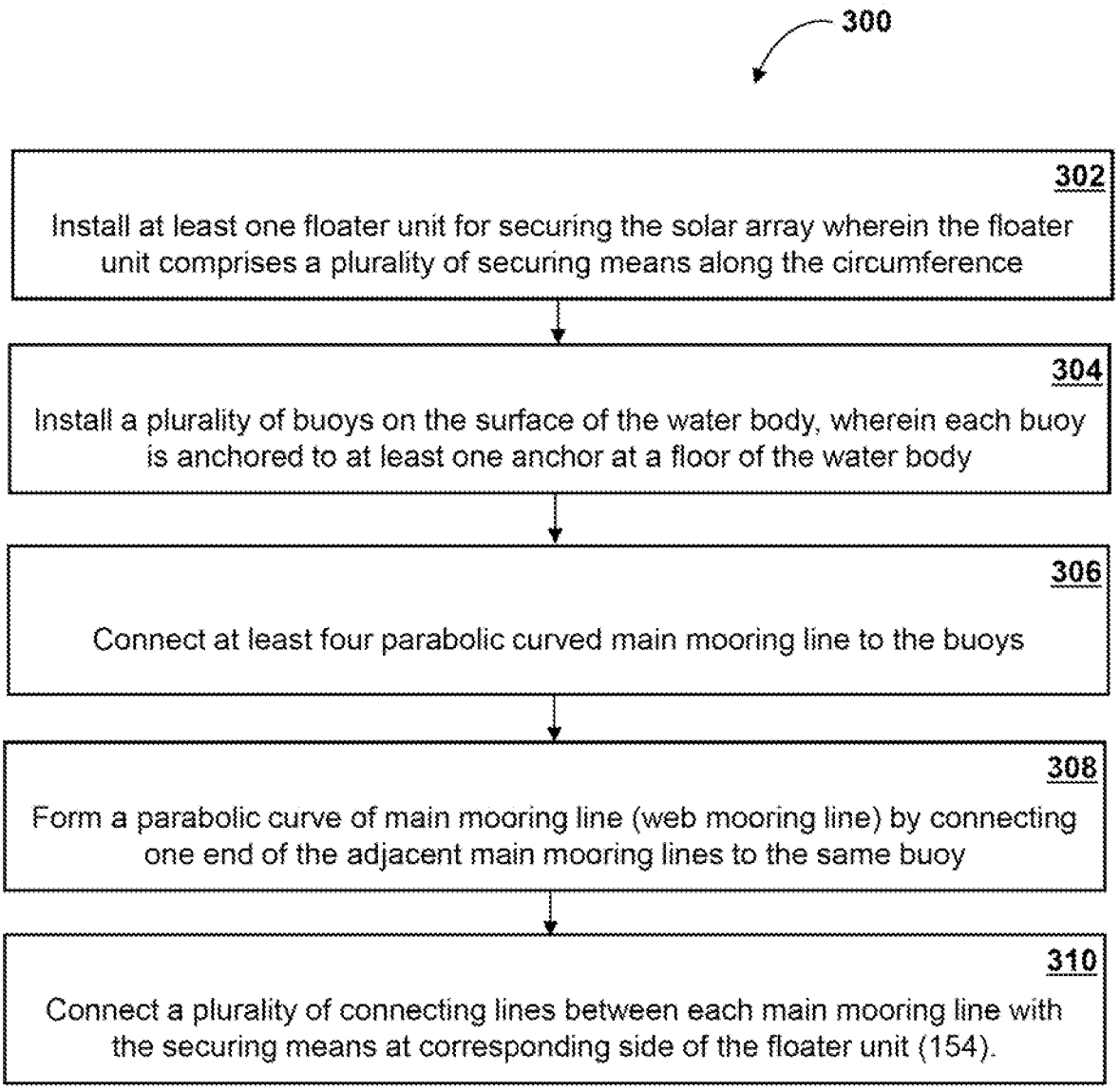
FIG. 4 shows an example flowchart pertaining to an example method for mooring and anchoring at least one solar array on a surface of a water body, in accordance with the present invention.

FIG. 4 shows an example flowchart pertaining to an example method 300 for mooring and anchoring at least one solar array on a surface of a water body, in accordance with the present invention. As at step 302, at least one floater unit for securing the solar array is installed on the water body. The floater unit comprises a plurality of securing means along the circumference. As at step 304, a plurality of buoys on the surface of the water body is installed. Each buoy is anchored to at least one anchor at a floor of the water body. As at step 306, wherein at least four parabolic curved main mooring lines are connected to the buoys. Then as at step 308, a parabolic curve of main mooring line is formed by connecting one end of the adjacent main mooring lines to the same buoy. Finally, as at step 310, a plurality of connecting lines are connected between each main mooring line with the securing means at corresponding side of the floater unit.

Figure 5:
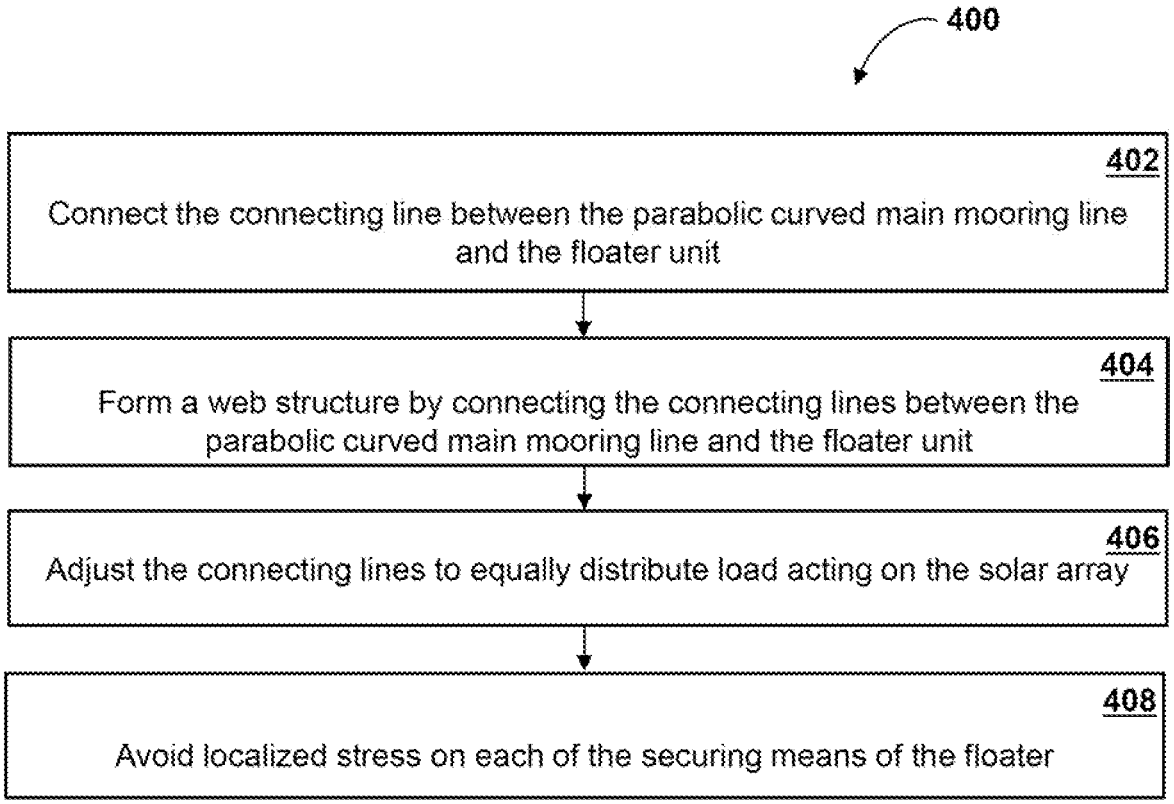
FIG. 5 shows an example flowchart pertaining to an example method for mooring and anchoring at least one solar array on a surface of a water body, in accordance with the present invention.

FIG. 5 shows an example flowchart pertaining to a method 400 for mooring and anchoring at least one solar array on a surface of a water body, in accordance with the present invention. As at step 402, the connecting line is connected between the parabolic curved main mooring line and the floater unit. In one embodiment of the invention, the length of the connecting line at the center of the parabolic curved main mooring line is shorter than the length of the connecting line connecting the sides of the parabolic curved main mooring line. In another embodiment of the invention, the length of the connecting lines that are near the buoys are greater than the length of the connecting lines that are away from the buoys.

As at step 404, a web structure is formed by connecting the connecting lines between the parabolic curved main mooring line and the floater unit. Then, as at step 406, the connecting lines are adjusted to equally distribute the load acting on the solar array. Finally, as at step 408, the web structure is capable of localizing the stress on each of the securing means of the floater.

Figure 6:
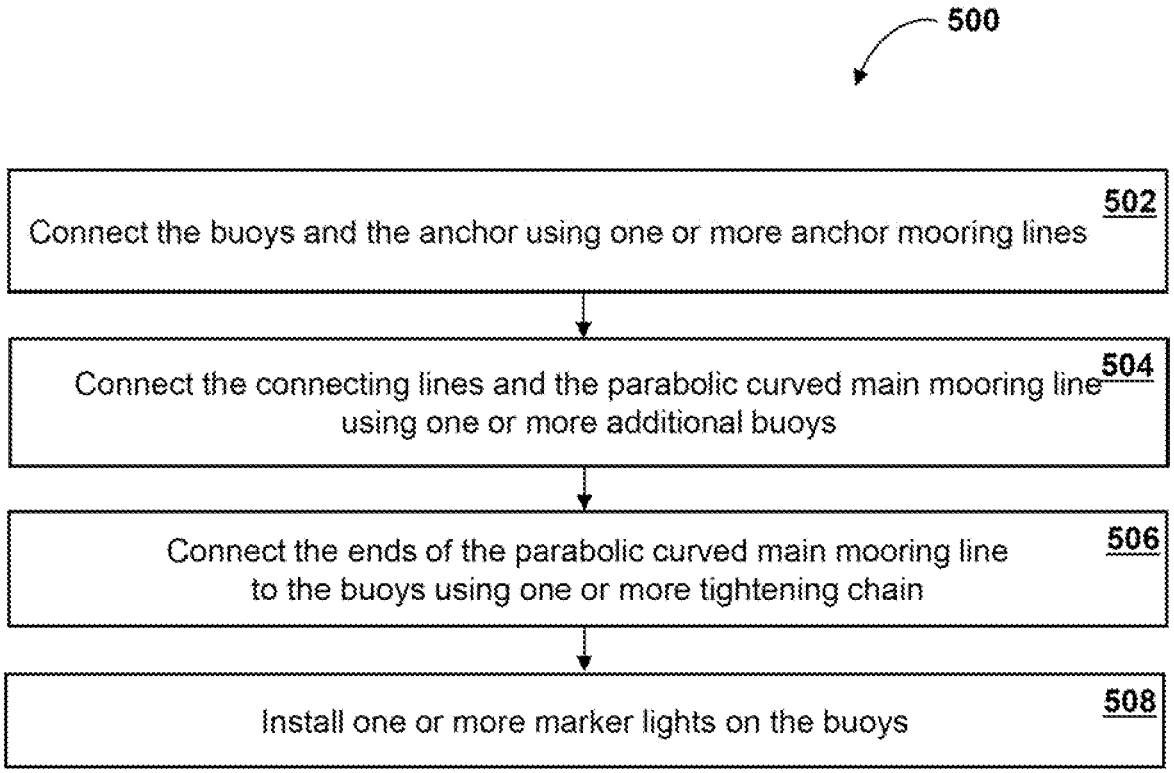
FIG. 6 shows an example flowchart pertaining to an example method for mooring and anchoring at least one solar array on a surface of a water body, in accordance with the present invention.

FIG. 6 shows an example flowchart pertaining to a method 500 for mooring and anchoring at least one solar array on a surface of a water body, in accordance with the present invention. As at step 502, the buoys and the anchor are connected using one or more anchor mooring lines. The connecting lines and the parabolic curved main mooring line are connected using one or more additional buoys, as at step 504. Then as at step 506, the ends of the parabolic curved main mooring line are connected to the buoys using one or more tightening chain. Finally, as at step 508, one or more marker lights are installed on the buoys.

A unique concept of mooring the floating solar arrays termed as 'web mooring' consists of a parabolic or curved mooring line. The 'web mooring' line will facilitate the connection of multiple mooring lines from the floaters of the solar arrays thereby reducing the load on the lug of the floaters to acceptable limits. Further the ends of the 'web mooring' are connected to the anchors through floating buoys connected at its ends.

The present invention is easy to install, because of the use of the main mooring line, lesser number of anchors are required to moor the lines anchors and hence it is relatively easy to install. The present invention is a flexible system. Depending on the magnitude of the environmental load, a greater number of array mooring lines can be connected as necessary. This flexibility to add many mooring lines help in reducing the load on the lugs of the array to acceptable limits. Thus, the utilization of the floaters which carry the solar panels can be improved. Since the main mooring line involves few anchors when compared with the standard floating solar mooring system, the time required for deploying the main mooring line is expected to be significantly lesser than that of a conventional system. With fewer number of anchors and lesser installation time, the cost of the present invention is expected to be less than that of a conventional solar mooring system.

It will be appreciated that variations of the above disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

Although embodiments of the current disclosure have been described comprehensively in considerable detail to cover the possible aspects, those skilled in the art would recognize that other versions of the disclosure are also possible.

What is claimed is:

1. A system for mooring and anchoring at least one set of solar panels on a surface of a water body, the system characterized in that comprising:

at least one floater unit for securing the at least one set of solar panels, wherein the at least one floater unit comprises a plurality of securing means along the circumference;

at least one or more parabolic curved main mooring line for forming a main securing means of the at least one floater unit along the circumference;

a plurality of buoys floating on the surface of the water body, wherein each of the plurality of buoys is anchored to at least one anchor at a floor of the water body; wherein the at least one or more parabolic curved main mooring line is attached to the plurality of buoys or to an anchor point on a shore of the water body; and a plurality of connecting lines, each for connecting a side of the at least one floater unit to one of the at least one or more parabolic curved main mooring line, wherein a length of each of the plurality of connecting lines is equal to a geometric distance between the plurality of securing means in one side of the at least one floater unit and, the respective at least one or more parabolic curved main mooring line, wherein the plurality of connecting lines connecting the at least one or more parabolic curved main mooring line has one or more additional buoys.

2. The system of claim 1, wherein the at least one or more parabolic curved main mooring line and the plurality of connecting lines form a web structure.

3. The system of claim 1, wherein the plurality of connecting lines connecting a center of the at least one or more parabolic curved main mooring line is shorter than the plurality of connecting lines connecting sides of the at least one or more parabolic curved main mooring line.

4. The system of claim 1, wherein the length of the plurality of connecting lines near the plurality of buoys are greater than the length of the plurality of connecting lines away from the plurality of buoys.

5. The system of claim 1, wherein the at least one or more parabolic curved main mooring line and the plurality of connecting lines equally distribute the load acting on the at least one set of solar panels.

6. The system of claim 1, wherein the at least one or more parabolic curved main mooring line and the plurality of connecting lines are connected such that to avoid localized stress on each of the plurality of securing means of the at least one floater unit.

7. The system of claim 1, wherein the plurality of buoys and the at least one anchor are connected using one or more anchor mooring lines.

8. The system of claim 1, wherein ends of the at least one or more parabolic curved main mooring line connected to the plurality of buoys has one or more tightening chains.

9. The system of claim 1, wherein the plurality of buoys has one or more marker lights.

10. The system of claim 1, wherein the number and size of the one or more additional buoys depends on the floating requirements of the at least one or more parabolic curved main mooring line.

11. A method for mooring and anchoring at least one solar array on a surface of a water body, the method characterized in that comprising:

installing at least one floater unit for securing a solar panel, wherein the at least one floater unit comprises a plurality of securing means along the circumference;

installing a plurality of buoys on the surface of the water body, wherein each of the plurality of buoys is anchored to at least one anchor at a floor of the water body;

connecting at least four parabolic curved main mooring line to the plurality of buoys;

forming a parabolic curve of main mooring lines by connecting one end of the adjacent main mooring lines to the plurality of buoys;

connecting a plurality of connecting lines between each of the main mooring lines with the plurality of securing means at a corresponding side of the at least one floater unit;

connecting the plurality of connecting lines between the at least four parabolic curved main mooring line and the at least one floater unit such that a length of the plurality of connecting lines near the plurality of buoys are greater than the length of the plurality of connecting lines away from the plurality of buoys;

forming a web structure by connecting the plurality of connecting lines between the at least four parabolic curved main mooring line and the at least one floater unit;

equally distributing, by the web structure, load acting on the at least one solar array;

avoiding, by the web structure, localized stress on each of the plurality of securing means of the at least one floater unit;

connecting the plurality of buoys and the at least one anchor using one or more anchor mooring lines;

connecting the plurality of connecting lines and the at least four parabolic curved main mooring line using one or more additional buoys;

connecting the ends of the at least four parabolic curved main mooring line to the plurality of buoys using one or more tightening chains; and installing one or more marker lights on the plurality of buoys.

12. The method of claim 11 further comprises:

connecting the plurality of connecting lines between the at least four parabolic curved main mooring line and the at least one floater unit such that the length of the plurality of connecting lines at a centre of the at least four parabolic curved main mooring line is shorter than the length of the plurality of connecting lines connecting the sides of the at least four parabolic curved main mooring line;

forming the web structure by connecting the plurality of connecting lines between the at least four parabolic curved main mooring line and the at least one floater unit;

adjusting the plurality of connecting lines to equally distribute load acting on the solar panel; and avoiding, by the web structure, localized stress on each of the plurality of securing means of the at least one floater unit.

* * * * *